US010704212B2

(12) United States Patent
Mannebach et al.

(10) Patent No.: US 10,704,212 B2
(45) Date of Patent: Jul. 7, 2020

(54) METHOD FOR COUPLING A MACHINE FRAME OF AN EARTH WORKING MACHINE TO A WORKING DEVICE, EARTH WORKING MACHINE, AND CONNECTING APPARATUS FOR THE METHOD

(71) Applicant: Wirtgen GmbH, Windhagen (DE)

(72) Inventors: Thomas Mannebach, Langenfeld (DE); Cyrus Barimani, Königswinter (DE); Christoph Menzenbach, Neustadt (DE)

(73) Assignee: Wirtgen GmbH (DE)

( * ) Notice: Subject to any disclaimer, the term of this patent is extended or adjusted under 35 U.S.C. 154(b) by 0 days.

(21) Appl. No.: 15/498,222

(22) Filed: Apr. 26, 2017

(65) Prior Publication Data

US 2017/0328018 A1 Nov. 16, 2017

(30) Foreign Application Priority Data

May 12, 2016 (DE) ..... 10 2016 208 242

(51) Int. Cl.
*E01C 23/08* (2006.01)
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/127
See application file for complete search history.

(56) References Cited

U.S. PATENT DOCUMENTS 2,125,134 A * 7/1938 Thompson ..... A01B 31/00 172/783
2,958,268 A * 11/1960 Moir ..... E01C 19/38 404/113

(Continued)

FOREIGN PATENT DOCUMENTS

CN 2816111 Y 9/2006
CN 202148487 U 2/2012

(Continued)

OTHER PUBLICATIONS

European Patent Office search report in European application EP 17 16 9866 dated Sep. 13, 2017, 8 pp (not prior art).

(Continued)

*Primary Examiner* — Janine M Kreck
(74) *Attorney, Agent, or Firm* — Lucian Wayne Beavers; Patterson Intellectual Property Law, PC

(57) ABSTRACT

A method for coupling a machine frame (12) of an earth working machine (10) to a working device (28) between the machine frame (12) and a substrate (U) encompasses the following steps:

arranging the machine frame (12) and the working device (28) between the machine frame (12) and the substrate (U);

aligning the receiving portion (42) and working device (28) relative to one another in such a way that fastening formations (56, 60) of the working device (28) are lined up, along a spacing direction, with fastening counter-formations (58, 62) of the machine frame (12);

bringing the fastening formations (56, 60) and fastening counter-formations (58, 62) closer to one another; and operably fastening the working device (28) onto the receiving portion (42).

According to the present invention the aligning step encompasses the following sub-steps:

(Continued)

connecting the machine frame (12) and the working device (28) to one another by means of a connecting apparatus (76), in such a way that the working device (28) is movable in response to its weight, parallel to the effective direction of gravity (g) and orthogonally thereto, relative to the machine frame (12); then allowing the working device (28) to hang on the machine frame (12); and then supporting the working device (28).

10 Claims, 7 Drawing Sheets

(56) References Cited

U.S. PATENT DOCUMENTS

| | | | | |
|---|---|---|---|---|
| 3,254,577 | A * | 6/1966 | Guntert | E01C 19/486 404/83 |
| 4,808,026 | A * | 2/1989 | Clarke, Jr. | E01C 19/187 172/108 |
| 5,470,131 | A | 11/1995 | Nolan et al. | |
| 8,820,510 | B2 * | 9/2014 | Forster | E01C 23/088 198/312 |
| 10,174,465 | B2 | 1/2019 | Steeg et al. | |
| 2012/0284989 | A1 | 11/2012 | Busley et al. | |
| 2016/0040371 | A1 | 2/2016 | Roetsch et al. | |
| 2016/0040372 | A1 | 2/2016 | Eiden | |
| 2017/0130406 | A1 † | 5/2017 | Steeg | |

FOREIGN PATENT DOCUMENTS

| | | | |
|---|---|---|---|
| CN | 106677039 | A | 5/2017 |
| DE | 102011018222 | A1 | 10/2012 |
| DE | 102013005594 | A1 | 10/2014 |
| DE | 102014011856 | A1 | 2/2016 |
| DE | 102015016678 | A1 † | 5/2017 |
| WO | 20120074415 | A1 | 6/2012 |

OTHER PUBLICATIONS

China Search Report for corresponding application No. 2019020100921320, dated Feb. 11, 2019, 8 pages (not prior art).

* cited by examiner
† cited by third party

METHOD FOR COUPLING A MACHINE FRAME OF AN EARTH WORKING MACHINE TO A WORKING DEVICE, EARTH WORKING MACHINE, AND CONNECTING APPARATUS FOR THE METHOD

BACKGROUND OF THE INVENTION

1. Field of the Invention

The present invention relates to a method for coupling a machine frame of an earth working machine, for example a road miller, stabilizer, or recycler, to a working device between a receiving portion of the machine frame which receives the working device and a substrate with which the earth working machine is in contact, the method encompassing the following steps:

arranging the machine frame and the working device relative to one another in such a way that the working device is located between the machine frame and the substrate;

aligning the receiving portion and working device relative to one another in such a way that fastening formations of the working device are lined up, along a spacing direction having a directional component orthogonal to the substrate, with fastening counter-formations, associated with the fastening formations and interacting for operable fastening of the working device onto the receiving portion, of the receiving portion;

bringing the fastening formations and fastening counter-formations closer to one another;

operably fastening the working device onto the receiving portion.

2. Description of the Prior Art

Methods of the species are known, for example, from US 2016/0040372 A1, DE 10 2013 005 594 A1, DE 10 2014 011 856 A1, or DE 10 2011 018 222 B4.

The method of the species very generally describes a procedure for replacing a working device of an earth working machine in order to operably couple a working device to the machine frame of the earth working machine.

The documents recited propose various procedures with which the machine frame and the working device, represented by a drum housing having a milling drum received rotatably therein, can be moved relative to one another so that the working device is located between the machine frame and the substrate. The documents US 2016/0040372 A1 and DE 10 2013 005 594 A1 propose for this purpose to shift the running direction of drive units of an earth working machine into a transverse machine frame direction, and then to move the machine frame, with the drive units, sideways in a transverse machine frame direction over a working device that has been furnished. The documents DE 10 2014 011 856 A1 and DE 10 2011 018 222 B4, on the other hand, propose a kinematic reversal of the procedure recited above, i.e. a movement of the working device in a transverse machine frame direction beneath a machine frame that has been furnished. An additional maneuvering apparatus is necessary for this purpose, since the working device of itself is usually not equipped to be movable relative to the substrate.

A characteristic common to all the methods proposed is that the receiving portion of the machine frame and the working device must be aligned relative to one another sufficiently exactly that the fastening formations and the fastening counter-formations can be brought into fastening engagement with one another after being brought closer to each other.

The substantial outlay associated with aligning of the working device and the receiving portion of the machine frame is disadvantageous, since both the machine frame and the working device each have a mass of over a ton, and thus present a correspondingly large amount of resistance to an aligning motion.

In order to facilitate alignment of the working device and machine frame, the existing art in some cases envisions the use of centering formations on the working device and machine frame, so that as the fastening formations and fastening counter-formations move closer to one another, automatic centering can occur thanks to a physical positive guidance by means of a centering engagement of the centering formations also produced as they move closer. This physical positive guidance upon alignment means a considerable mechanical load on the participating centering formations, however, since the working device, which as a rule is lighter but still has a mass of up to several tons, must have an aligning motion imparted to it via the centering formations.

SUMMARY OF THE INVENTION

An object of the present invention is therefore to furnish a technical teaching that enables simplified alignment of the receiving portion and working device as compared with the existing art.

This object is achieved according to the present invention by way of a method of the kind recited previously in which the aligning step encompasses the following sub-steps:

connecting the machine frame and the working device to one another by means of a connecting apparatus that comprises a frame coupling portion configured for coupling to the machine frame and a device coupling portion arranged at a distance from the frame coupling portion and configured for coupling to the working device, in such a way that the working device is movable in response to its weight, parallel to the effective direction of gravity and orthogonally thereto, relative to the machine frame; then allowing the working device, movably connected to the machine frame by means of the connecting device, to hang; and the supporting the working device.

Thanks to establishment of the connection of the machine frame to the working device by means of the above-described connecting apparatus, the working device can be connected swingingly to the machine frame, so that when the working device connected to the machine frame is allowed to hang therefrom, said device can move automatically, in gravity-driven fashion, into a predetermined relative position relative to the machine frame If the connecting apparatus is correspondingly dimensioned, and/or if the connecting apparatus is correspondingly oriented between the machine frame and the working device when its coupling portions are coupled to the machine frame and to the working device, the working device can then assume, solely in response to its weight, a predetermined relative position in which the fastening formations and fastening counter-formations are sufficiently aligned in an alignment plane spanned by parallels to the longitudinal machine frame direction and to the transverse machine frame direction, and can easily be brought closer to one another. The vertical location of the alignment plane relative to the earth working machine is immaterial in this context. The alignment plane serves merely to indicate a relative location of the working device and machine frame, regardless of the vertical location of the working device, only in the "longitudinal machine frame direction" and "transverse machine frame direction" coordinates.

For easier alignment of the working device relative to the machine frame, the machine frame is preferably arranged, before or during alignment, in such a way that the alignment plane is oriented orthogonally to the effective direction of gravity.

In order to produce the swinging connection of the working device to the machine frame, the connecting step can very generally encompass a connecting of the device coupling portion to at least one device coupling formation of the working device, and a connecting of the frame coupling portion to at least one frame coupling formation of the machine frame. In principle, the at least one device coupling formation and the at least one frame coupling formation can respectively be provided at any locations on the working device on the one hand and on the machine frame on the other hand. This is because the connecting apparatus arranged between the at least one device coupling formation and the at least one frame coupling formation can ensure, when the working device is hanging freely on the machine frame, that the working device assumes with respect to the machine frame a relative position that results in an arrangement, lined up along the spacing direction, of the fastening formations and fastening counter-formations in the alignment plane referred to above.

The number of device coupling formations can be greater or less than the number of frame coupling formations, for example if the connecting apparatus branches between the frame coupling portion and device coupling portion. Because three points define a plane, it is advantageous if three non-collinear coupling portions, provided with a spacing from one another, are provided on at least one object from among the machine frame and working device. It is sufficient in principle if only one coupling portion is provided on the respective other object from among the machine frame and working device; an additional adjustment intervention by one or more persons may then be necessary in order to prevent or correct a relative rotation, possible in principle when only exactly one coupling formation is present at one end of the connecting apparatus between the working device and machine frame, around a rotation axis parallel to the effective direction of gravity. If at least three non-collinear coupling formations are provided on one object from among the machine frame and working device, and if at least two coupling formations are provided on the respective other object, the relative rotation around a rotation axis parallel to the effective direction of gravity can be hindered or in fact prevented. With at least three non-collinear coupling formations provided with a spacing from one another respectively on the machine frame on the one hand and on the working device on the other hand, the relative position assumed by the working device relative to the machine frame when said device hangs freely on said frame can be uniquely determined regardless of where the center of gravity of the working device is located. This is because the connecting apparatus, via three device coupling formations that are arranged non-collinearly on the working device, can absorb gravity-related tilting moments at the coupling points, so that such tilting moments do not result in a tilting motion of the working device relative to the machine frame.

When it is stated above that the working device is "movable in response to its weight parallel to the effective direction of gravity and orthogonally thereto," this is to be understood as an indicator of the rigidity of the connecting apparatus. The connecting apparatus therefore need not be so flexurally limp that it is already deformable in the unconnected state when not coupled to the machine frame and working device. When the working device is suspended swingingly via the connecting apparatus on the machine frame, however, the connecting apparatus should permit the above-described motion driven by the weight of the working device.

The movability parallel to the effective direction of gravity and orthogonally thereto is intended to ensure that when the working device hangs freely on the machine frame, it assumes a desired relative position in which the working device has the lowest potential energy. If the working device is in a position of higher potential energy, the connecting apparatus is intended to enable a movement of the working device in the effective direction of gravity until the location of lowest potential energy is reached. In the context of this movement, the connecting apparatus guides the working device orthogonally to the effective direction of gravity, just as in the case of a pendulum, so that when the working device reaches the location of lowest potential energy and comes to rest in it, said device assumes in the aforementioned alignment plane a desired final position from which the fastening formations and fastening counter-formations can be brought closer to another in order to achieve a fastening engagement between them.

If the working device is located between the substrate and the machine frame but is offset, in the longitudinal machine frame direction and/or in the transverse machine frame direction, with reference to its position relative to the machine frame in the alignment plane as compared with its fastening position that enables operable fastening of the working device onto the machine frame, that offset can be eliminated by the above-described use of the connecting apparatus and by the swinging suspension, enabled thereby, of the working device on the machine in the manner described.

The frame coupling portion of the connecting apparatus can comprise one or more coupling shapes each of which is couplable, preferably positively couplable, to a frame coupling formation. The device coupling portion of the connecting apparatus can likewise comprise one or more device coupling shapes each of which is couplable to a device coupling formation. This coupling is also preferably positive in order to ensure that the largest possible forces can be transferred.

Corresponding to what was stated above, the number of frame coupling shapes can be greater or less than the number of device coupling shapes.

The connecting apparatus preferably comprises as many frame coupling shapes as device coupling shapes, so that when the working device is hanging freely on the machine frame, the forces acting on the coupling shapes can be distributed as uniformly and homogeneously as possible among the coupling shapes that are present. The number of frame coupling formations is therefore also preferably equal to the number of device coupling formations.

Although the device coupling formations and/or frame coupling formations can be provided at any locations on the working device and/or on the machine frame, the at least one device coupling formation is preferably a fastening formation and/or the at least one frame coupling formation is preferably a fastening counter-formation. The manufacturing outlay for the earth working machine can be decreased thanks to the use of already existing fastening formations and/or fastening counter-formations respectively as device coupling formations and as frame coupling formations, since there is no need to configure and provide coupling formations in addition to the fastening formations and/or fastening counter-formations.

The spacing direction in which the fastening formations and associated fastening counter-formations are lined up with one another preferably proceeds parallel to the effective direction of gravity, so that the fastening formations and fastening counter-formations can be brought closer to one another by simply lifting the working device oppositely to the effective direction of gravity and/or lowering the machine frame in the effective direction of gravity. In this case alignment of the working device can furthermore be accomplished with great precision by suspending it swingingly on the machine frame and allowing it to hang thereon, since swinging suspension of the working device on the machine frame in such a way that associated fastening formations and fastening counter-formations come to rest exactly above one another in the effective direction of gravity, after the decay of a swinging motion oscillating back and forth which can possibly occur as hanging begins, can be implemented particularly easily.

The step of arranging the machine frame and the working device relative to one another in such a way that the working device is located between the machine frame and the substrate can encompass a movement of the machine frame relative to the substrate over the working device. This movement preferably occurs parallel to the alignment plane. Additionally or alternatively, the arranging step can encompass a movement of the working device, received on a transport carriage, beneath the machine frame. Usually the movement of the machine frame and/or the movement of the working device comprises a movement component in the transverse machine frame direction, or in fact proceeds predominantly or entirely in the transverse machine frame direction.

According to an embodiment of the present invention, the step of allowing the working device movably connected to the machine frame to hang can encompass a lifting of the machine frame relative to the substrate and/or a lowering of a carrying device of a transport carriage, which carries the working device, relative to the substrate. The lifting of the machine frame in particular can be implemented in simple fashion if the machine frame of the earth working machine is supported, as is often the case, vertically adjustably above the substrate by means of a lifting unit. The lifting unit can encompass one or more lifting columns with which drive units of the machine are arranged vertically adjustably on the machine frame, for example via hydraulic piston/cylinder arrangements.

The step of supporting the working device can likewise encompass a lowering of the machine frame relative to the substrate, in particular until the working device sits on the substrate, and/or a lifting of a carrying device of a transport carriage, which carries the working device, relative to the substrate. Once again, when the aforementioned lifting unit is present, lowering of the machine frame by means of the lifting unit is preferred.

As has already been indicated above, an adjustment of the working device relative to the machine frame can be necessary in addition to merely allowing the working device to hang on the machine frame, for example when the connecting apparatus permits even a small relative rotation between the working device and machine frame around the yaw axis of the machine.

The gravity-driven automatic alignment as a result of the swinging suspension of the working device on the machine frame can be regarded as completed when the fastening apparatuses and the fastening counter-apparatuses are arranged with a spacing from one another along the effective direction of gravity and are lined up with one another. Operable fastening of the working device onto the receiving portion can then be achieved by bringing the machine frame and working device closer to one another parallel to the effective direction of gravity. Preferably the connecting apparatus itself proceeds parallel to the effective direction of gravity with the working device in the aligned state. The connecting apparatus can encompass at least locally, for example, a chain or a cable that then, in the completely aligned state in which supporting occurs, is preferably located in a position extended parallel to the effective direction of gravity.

Consideration can be given in principle to leaving the connecting apparatus permanently coupled to the machine frame and/or to the working device. For example, a working machine having a connector apparatus permanently coupled to it can be configured for alignment of a working device without prior fitting.

It can also be advantageous, however, to remove the connecting apparatus from the earth working machine when it is no longer needed. This is the case, for example, when the connecting apparatus is coupled to the fastening formations and/or to the fastening counter-formations on the machine frame side and/or on the working device side, so that the connecting apparatus could prevent the establishment of a fastening engagement between the aforesaid formations, or even prevent the fastening formations and the fastening counter-formations from coming closer to one another.

Because the connecting apparatus is no longer needed once the working device is supported, the connecting apparatus is preferably removed after the working device is supported and before the working device is fastened onto the receiving portion. When a separate fastening means, such as a fastening bolt, a fastening screw, or a screw/nut combination, is required for operable fastening of the working device onto the receiving portion, the connecting apparatus can be replaced by the fastening means.

It is conceivable in principle for the connecting apparatus to encompass exactly one piece, for example when the connecting apparatus branches between the frame coupling portion and the device coupling portion. Preferably, however, the connecting apparatus comprises a plurality of connecting sub-apparatuses, each of which comprises a frame coupling portion embodied for coupling to the machine frame and a device coupling portion arranged at a distance from the frame coupling portion and embodied for coupling to the working device. The statements made above with regard to the connecting apparatus are preferably also valid for at least some, particularly preferably for all, of the connecting sub-apparatuses.

The connecting sub-apparatuses can be connected to one another continuously with each other via a common connecting component, or can form the connecting apparatus in unconnected fashion as separate sub-components. For example, each connecting sub-apparatus can comprise at least locally a chain and/or a cable. Because of the greater load capacity of cables and because of the greater internal friction between the cable strands furnished by cables as compared with chains, the use of cable material to constitute the connecting apparatus or the connecting sub-apparatuses is preferred.

The cable portions or chain portions of the connecting apparatus or the connecting sub-apparatuses in general can be provided, in the state coupled to the working device and machine frame, with a tilt with respect to one another, so that forces acting in the alignment plane add up to a total force of zero.

Based on the advantageous effect of the working device suspended swingingly on the machine frame for the purpose of aligning the working device and machine frame, the present invention also relates to an earth working machine having a machine frame and having a working device connected to the machine frame, in which the working device is connected to the machine frame by means of a connecting apparatus that comprises a frame coupling portion coupled to the machine frame and a device coupling portion arranged at a distance from the frame coupling portion and coupled to the working device, the frame coupling portion and the device coupling portion being movable relative to one another in the coupled state, in response to the weight of the working device, at least parallel to the effective direction of gravity and orthogonally thereto. In order to allow the most comprehensive possible alignment movability of the working device relative to the machine frame to be furnished, provision is made that the working device is connected to the machine frame only by means of the connecting apparatus. This means that at least for a time period during the alignment operation, the working device does not have a rigid connection to the machine frame.

The earth working machine claimed above is not operable per se because of the swinging suspension of the working device on the machine frame, but is furnished as an earth working machine in the above-described configuration for more than just a brief moment in order to achieve successful alignment.

In order to reliably ensure the alignment movement of the working device relative to the machine frame, provision is preferably made that the working device is suspended on the machine frame in freely hanging fashion by means of the connecting apparatus, with a spacing from a substrate with which the earth working machine is in contact. Alternatively, consideration can also be given to having the working device rest on a movable transport carriage having a supporting surface deflecting toward the substrate. In this case as well, the working device would be movable, parallel to the effective direction of gravity and orthogonally thereto, relative to the machine frame.

In a manner known per se, the earth working machine according to the present invention is preferably a self-propelled earth working machine having a propelling unit and a propelling drive system. The propelling unit encompasses at least two drive units, preferably three or four or more drive units, which roll on the substrate with which the machine is in contact. In order to establish a desired travel direction of the earth working machine, at least some of the drive units are steerable. Preferably all the drive units are steerable, preferably in accordance with the Ackermann condition known per se. The drive units can each have one or more support wheels, or can comprise a drive track in order to achieve a large contact area with a correspondingly low area load.

The machine frame is preferably vertically adjustable with respect to the substrate by means of a lifting unit, as has already been set forth above. Preferably the lifting unit for each drive unit has an adjustable-height lifting column with which the drive unit is vertically adjustably coupled to the machine frame. The refinements of the connecting apparatus described above in connection with the method according to the present invention also apply to the connecting apparatus recited as a component of the earth working machine. Said apparatus is identical to the connecting apparatus of the method.

Based on the advantageous effect of a working device suspended in freely hanging fashion on the machine frame in terms of alignment thereof relative to the machine frame, the present invention further relates to a use of a connecting apparatus for swingably hanging connection of a machine frame of an earth working machine, for example a road miller, stabilizer, or recycler, to a working device embodied in terms of operation for rigid fastening onto the machine frame, the connecting apparatus comprising a frame coupling portion embodied for coupling to the machine frame and a device coupling portion arranged at a distance from the frame coupling portion and embodied for coupling to the working device, the frame coupling portion and the device coupling portion being inclinable relative to one another around a displacement axis orthogonal to the distance direction, in particular by bending of the connecting apparatus.

In addition to the components (cable or chain) already recited above, the connecting apparatus can also encompass a telescoping linkage. The connecting apparatus can in fact be constituted solely by a telescoping linkage if the frame coupling portion and device coupling portion of the connecting apparatus permit a relative rotation around at least two mutually orthogonal rotation axes in a state in which the machine frame and the working device are coupled. The inclination capability is then omitted.

The working device can be, for example, a milling drum mounted rotatably in a drum housing, or a mixing rotor furnished rotatably in a device housing.

BRIEF DESCRIPTION OF THE DRAWINGS

The present invention will be explained in further detail below with reference to the appended drawings, in which.

DETAILED DESCRIPTION OF THE INVENTION

Figure 1:
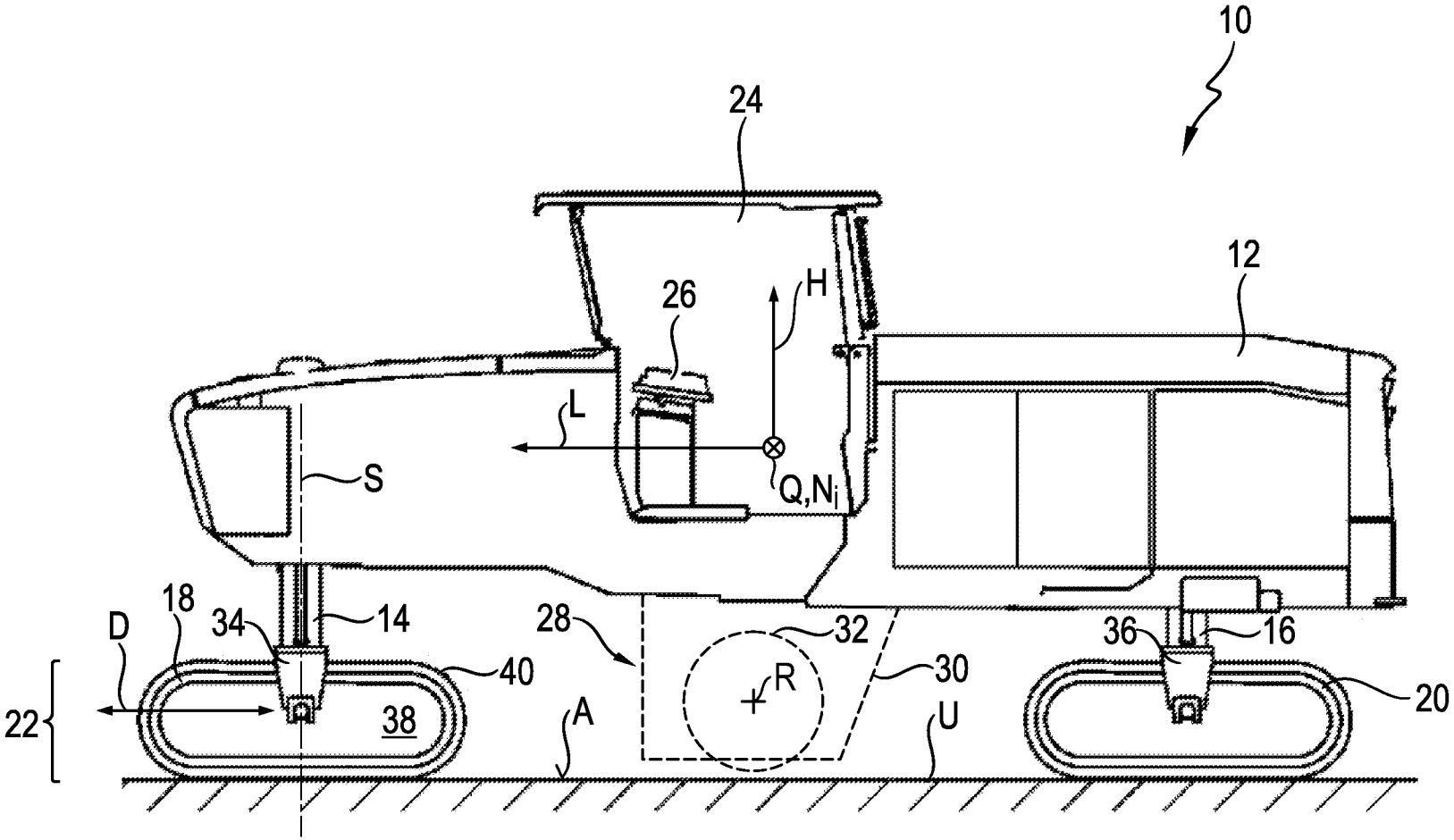
FIG. 1 is a side view, in a transverse machine frame direction, of an earth working machine in the exemplifying form of a large milling machine, on which the method according to the present invention can be utilized.

The viewer of FIG. 1 is looking toward earth moving machine 10, or simply the "machine," in transverse machine direction Q that is orthogonal to the drawing plane of FIG. 1. The longitudinal machine frame direction is labeled L, and proceeds parallel to the drawing plane of FIG. 1. The vertical machine direction H also proceeds parallel to the drawing plane of FIG. 1, and orthogonally to the longitudinal and transverse machine directions L and Q. The arrowhead of longitudinal machine direction L in FIG. 1 points in a forward direction. For clarification, the vertical machine frame direction H is parallel to the direction in which lifting columns 14 and 16 proceed. Vertical machine direction H proceeds parallel to the yaw axis of machine 10, longitudinal machine direction L proceeds parallel to the roll axis, and transverse machine direction Q proceeds parallel to the pitch axis Ni.

Earth working machine 10 can comprise an operator's platform 24 from which a machine operator can control machine 10 via a control console 26.

Indicated beneath machine frame 12, merely with dashed lines and only in FIG. 1, is a working device 28, in this case e.g. as a milling device 28 having a milling drum 32 which is received in a milling housing 30 and is rotatable around a milling axis R proceeding in transverse machine frame direction Q in order thereby to allow substrate material to be removed, starting from contact surface A of substrate U, to a milling depth determined by the relative vertical position of machine frame 12. The vertical adjustability of machine frame 12 thanks to lifting columns 14, 16 therefore also serves for establishment of the milling depth, or in general working depth, of machine 10 in the context of earth working. Earth working machine 10 depicted by way of example is a large milling machine for which the arrangement of milling device 28 in longitudinal machine frame direction L between front drive unit 18 and rear drive unit 20 is typical. Large milling machines of this kind, or also earth-removing machines in general, usually have a transport belt for transporting removed earth material away from machine 10. A transport belt that is also present in principle on machine 10 is not depicted in FIG. 1 in the interest of better clarity.

It is not apparent from the side view of FIG. 1 that machine 10 has, both in its front end region and in its rear end region, two respective lifting columns 14 and 16 each having a respective drive unit 18 and 20 connected to it. Lifting column 14 is furthermore coupled by means of a coupling structure 34, in a manner known per se, to drive unit 18. The rear lifting columns 16 are connected to their respective drive unit 20 via a coupling structure 36 constructed identically to coupling structure 34. Drive units 18 and 20 are of substantially identical construction, and constitute propelling unit 22 of the machine.

In the example depicted, drive unit 18, having a drive direction indicated by double arrow D, comprises a radially inner receiving structure 38 on which a circulating drive track 40 is arranged.

Lifting column 14, and with it drive unit 18, is rotatable around a steering axis S by means of a steering apparatus (not depicted in further detail).

Figure 2:
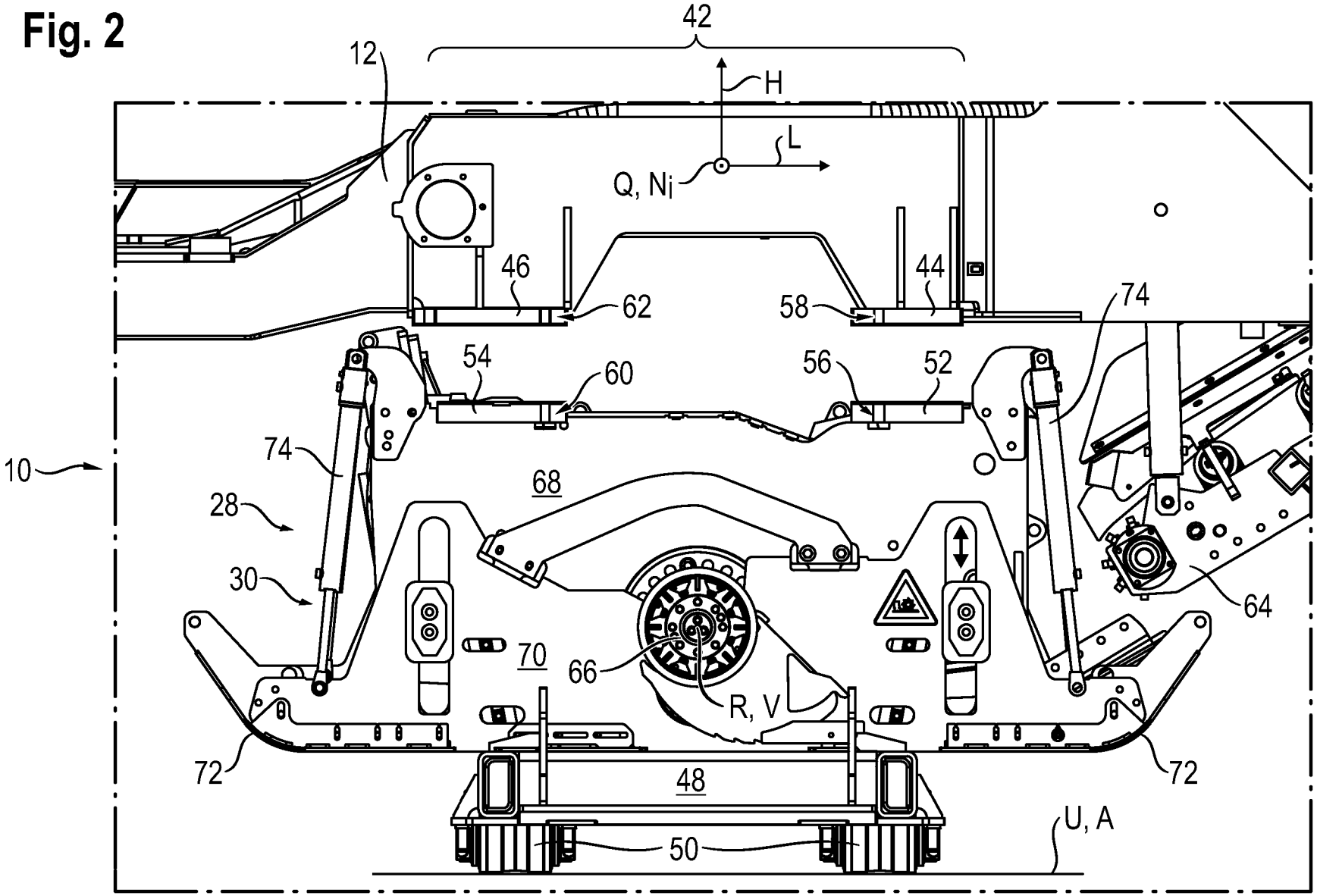
FIG. 2 shows the region of a receiving portion of the machine frame of the machine of FIG. 1 upon initiation of arranging a milling device thereon, the milling device having been moved, with a maneuvering device in the region of the receiving portion, beneath the receiving portion.

FIG. 2 shows in enlarged fashion only that portion of earth working machine 10 which is of interest for execution of the method according to the present invention. The method according to the present invention is executed in this region, at the conclusion of which method a milling device 28 is fastened operably onto machine frame 12.

Machine frame 12 comprises, in a manner known per se, a receiving portion 42 that is configured for operable fastening of milling device 28 onto said frame. Receiving portion 42 of machine frame 12 comprises for this purpose, for example, a front frame installation plate 44 and a rear frame installation plate 46.

In the example depicted, milling device 28 is placed on a transport apparatus or maneuvering apparatus 48 that is in contact with substrate U by way of roller dollies 50 in FIG. 2.

Milling device 28 has been conveyed parallel to transverse machine frame direction Q using maneuvering apparatus 48, which is known per se, beneath machine frame 12 in the region of receiving portion 42. Milling device 12 is thus located, roughly oriented, in the vicinity of the alignment position in which operable fastening of milling device 28 onto machine frame 12 can occur.

Milling device 28 comprises a front device installation plate 52 and a rear device installation plate 54. In the final operably mounted state, front frame installation plate 44 and front device installation plate 52 abut against each other, as do rear frame installation plate 46 and rear device installation plate 54. In an aligning step to be explained below, milling device 28 and machine frame 12, or its receiving portion 42, will be aligned with one another in such a way that a front fastening formation 56 in front device installation plate 52 lines up with a front fastening counter-formation 58 in front frame installation plate 54. The same applies to a rear fastening formation 60 in rear device installation plate 54, which is to be oriented so it lines up with a rear fastening counter-formation 62 in rear frame installation plate 46.

For maximally exact alignment of milling device 28 and receiving portion 42 relative to one another parallel to transverse machine frame direction Q, milling device 28 and receiving portion 42 comprise at least one further pair of fastening formations and fastening counter-formations, preferably at least two further pairs of fastening formations and fastening counter-formations, shifted behind the drawing plane of FIG. 2, although they are concealed by the apparatus components depicted in FIG. 2 and are therefore not visible.

Merely for the sake of completeness, it is pointed out here that the longitudinal end, closest to the milling drum, of a transport device 64 is visible on machine frame 12; with this device, substrate removed by milling drum 32 (not visible in FIG. 2) can be transported away from earth working machine 10.

Milling drum 32 (not depicted in FIGS. 2 to 6) is received, with a rotation axis R proceeding parallel to transverse machine direction Q, in drum housing 30 by means of milling drum bearing system 66 visible in part in FIGS. 2 to 7. A stationary side wall 68 of drum housing 30, and a movable side panel 70 provided at the lower end of drum housing 30 remote from the machine frame, are apparent in FIG. 2. Side panel 70 is received vertically displaceably on the stationary side wall 68 respectively in front of and behind milling drum 32 in longitudinal machine direction L, the vertically adjustable receptacles being sufficiently motion-tolerant in longitudinal machine direction L that movable side panel 70 can also tilt slightly, as a result of different amounts of vertical displacement at its bearing points in front of and behind milling drum 32, around a tilt axis V proceeding parallel to transverse machine direction Q, which in the present example coincides with the rotation axis R of milling drum 32. Movable side panel 70 runs on substrate U on a skid 72, and can be lifted off substrate U by means of arrangements 74 at its two longitudinal end regions.

Figure 3:
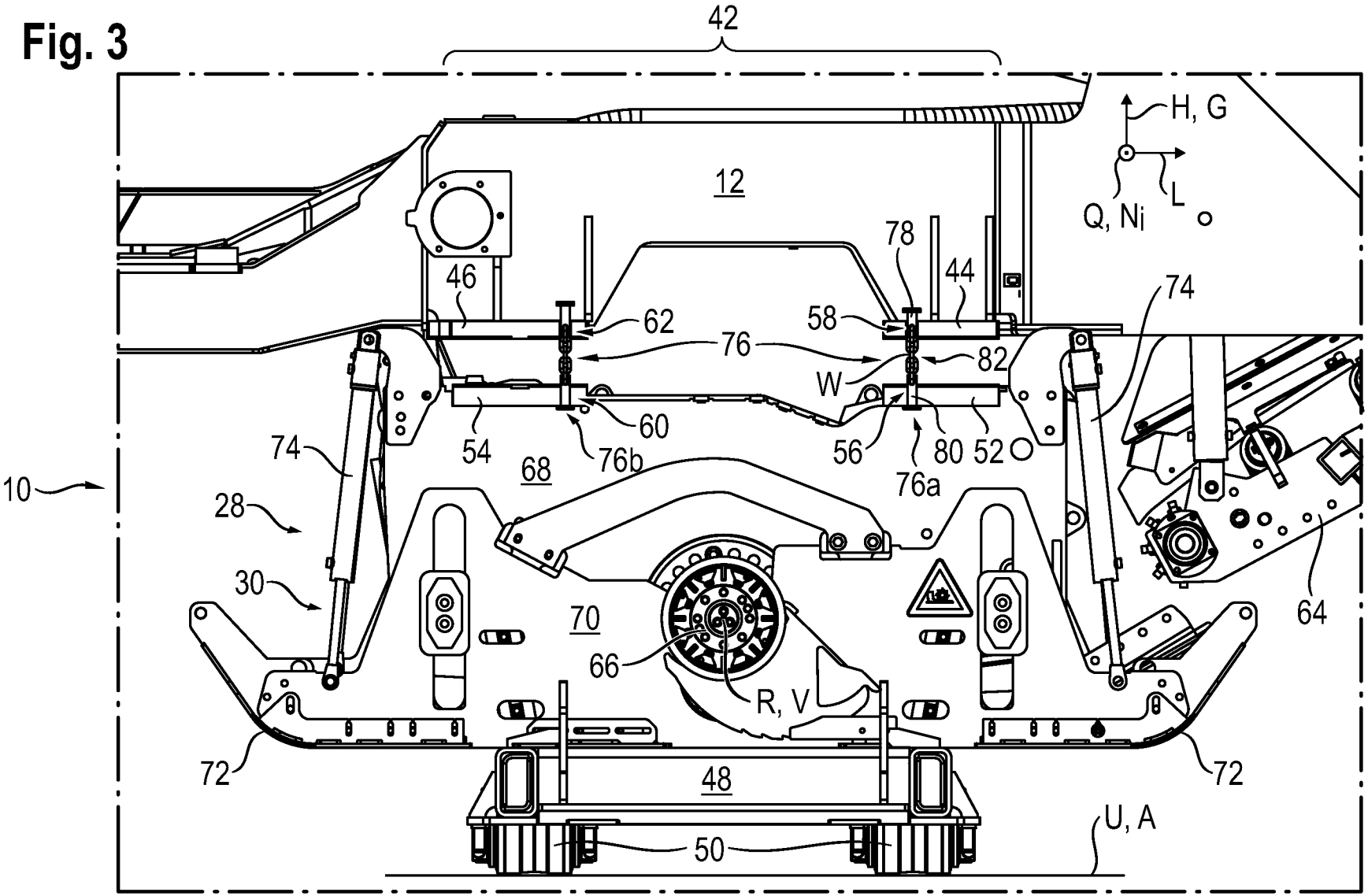
FIG. 3 shows the view of FIG. 2 with the machine frame moved slightly closer to the milling device, a connecting apparatus being arranged between the machine frame and the milling device.

In FIG. 3, machine frame 12 has been brought sufficiently close to milling device 28, by adjusting front and rear lifting columns 14 and 16, that a connecting apparatus 76 can be arranged between frame installation plates 44 and 46 and the associated device installation plates 52 and 54, so as to connect milling device 28 movably, more precisely swingingly movably, relative to machine frame 12. Connecting apparatus 76 may also be referred to as a connector 76.

In the present example, connecting apparatus 76 comprises several connecting sub-apparatuses 76*a* and 76*b* as well as, preferably, further connecting sub-apparatuses, preferably of the same nature, that are not depicted. Connecting sub-apparatuses 76*a* and 76*b* may also be referred to as sub-connectors 76*a* and 76*b*.

Connecting sub-apparatus 76*a* will be described below as an example of all the connecting sub-apparatuses. Said apparatus comprises a frame coupling portion 78 and a device coupling portion 80. Coupling portions 78 and 80 are of substantially identical construction and encompass a solid shank having a T-head, i.e. a head whose diameter is larger than that of the shank. The shank and T-head can in principle represent separate components that can be detachably connected to one another, for example, by means of a threaded or insertion connection. Alternatively, a coupling portion can encompass components which are movable, in particular pivotingly movable, relative to one another, and are displaceable between an installation position in which they can be led in a leadthrough direction through an opening or bore in an installation plate, and an engagement position in which they cannot be led through the opening or bore oppositely to the leadthrough direction, for example because in the engagement position, at least one of the components is braced against that region of the installation plate which surrounds the opening or bore. In addition, coupling shapes of the connecting apparatus and fastening formations and/or fastening counter-formations can comprise hooks and eyes. To safeguard against bending under load, a hook can be configured as a carabiner hook.

The shanks of coupling portions 78 and 80 pass respectively through fastening formation 56 and fastening counter-formation 58, and the respective heads abut against the surfaces of installation plates 54 and 52 which face away from one another so that they can discharge into the respective installation plates 54 and 52 the tensile forces acting on connecting sub-apparatus 76*a*. Thus in this example the fastening formation 56 and fastening counter-formation 58 may also be referred to as a device coupling formation 56 and a frame coupling formation 58, respectively. The shank, having a larger-diameter T-head, of frame coupling portion 78 forms an aforementioned frame coupling shape that is configured for coupling to the fastening counter-formation. The shank, having a larger-diameter T-head, of device coupling portion 80 forms an aforementioned device coupling shape that is configured for coupling to fastening formation 56.

Between coupling portions 78 and 80, connecting sub-apparatus 76*a* comprises a movement portion 82 that makes possible a relative movement of coupling portions 78 and 80, at least in response to the weight of milling device 28, around a bending axis W that, in a completely coupled state, is orthogonal to vertical machine frame direction H and to yaw axis G which is parallel to the latter. Bending axis W is drawn in FIG. 3 orthogonally to the drawing plane of that Figure. It lies in fact in an alignment plane that is spanned by parallels to longitudinal machine frame direction L and to transverse machine frame direction Q.

Instead of the chain depicted by way of example in movement portion 82, connecting sub-apparatus 76*a* can also comprise a cable segment. The shanks (solid, in the example depicted) of coupling portions 78 and 80 can likewise be constituted by a chain or a cable.

Figure 4:
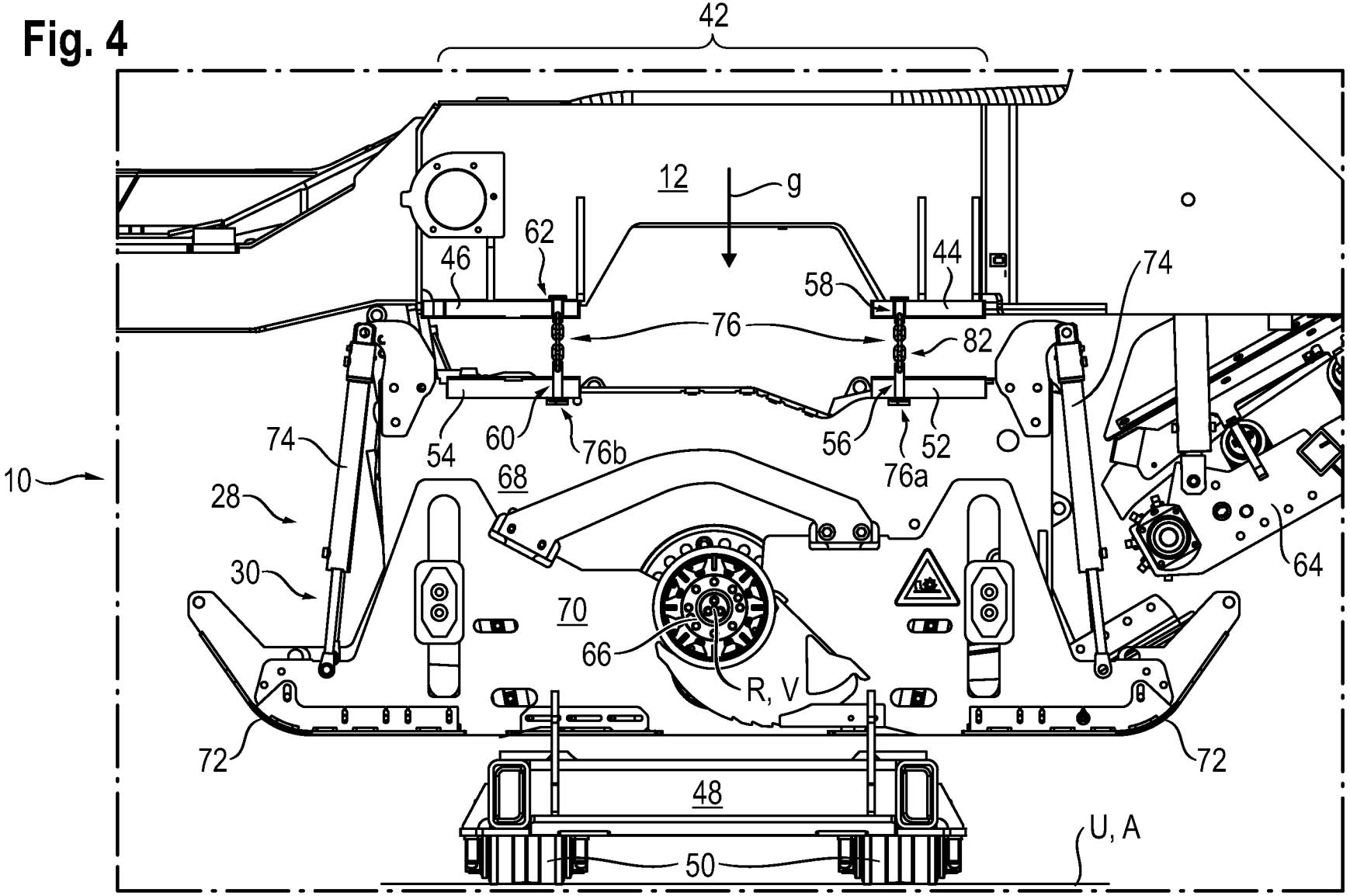
FIG. 4 shows the view of FIG. 3, the machine frame and the milling device, connected to it by means of the connecting apparatus, being lifted in such a way that the milling device is hanging freely on the machine frame.

FIG. 4 shows the advantageous alignment of milling device 28 relative to machine frame 12. Compared with the state in FIG. 3, machine frame 12 has been lifted by lifting columns 14 and 15 with respect to substrate U, and milling device 28, connected to machine frame 12 solely via connecting apparatus 76, has thereby been lifted off from substrate U.

Milling device 28 in FIG. 4 is swingingly connected, solely via connecting apparatus 76, to machine frame 12 and hangs freely therefrom.

"Swinging(ly)" does not mean, for purposes of the present Application, that milling device 28, or a working device in general, actually needs to perform a swinging motion. It simply means that it can perform such a motion. The swinging motion means that milling device 28 can perform a motion orthogonally to the effective direction of gravity g, in which context, because of the suspension on machine frame 12 with each connecting sub-apparatus 76*a* and 76*b*, it travels in positively guided fashion along a partial circular path, so that with increasing deflection orthogonally to the effective direction of gravity it is moved away from the extended state shown in FIG. 4 and away from substrate U, and thus gains potential energy. The potential energy at the top dead center point of a swinging motion acts as an energy source for a subsequent return motion back to the extended position depicted (bottom dead center point). This can be overshot, and because of the external friction between connecting apparatus 76 and machine frame 12 on the one hand and milling device 28 on the other hand, and because of the internal friction within connecting apparatus 76, this swinging motion is gradually brought to a stop, which will then occur at the point at which the milling device exhibits the lowest potential energy under the respectively existing suspension conditions. Graphically, the farther away milling device 28 is from its alignment position required for operable fastening onto machine frame 12 before hanging freely in the alignment plane, the greater the amplitude of the swinging motion that will take place. This does not represent a problem, however, since the swinging motion will always end in the region of the alignment position. With a greater initial amplitude it can simply take longer for the swinging motion to decay than with a smaller initial motion amplitude. If the aforesaid friction effects cause the motion to decay before milling device 28 reaches its exact alignment position, the relative position of the freely hanging milling device 28 can be manually adjusted until sufficient alignment is attained.

Connecting sub-apparatuses 76*a*, 76*b*, and further connecting sub-apparatuses not depicted, are dimensioned in such a way that in a coupled state they reach their extended position, in which the potential energy of milling device 28 assumes a minimum, when fastening formations 56 and 60 and the associated fastening counter-formations 58 and 62 are aligned with one another in such a way that they can be fastened operably onto one another merely by bringing machine frame 12 and milling device 28 closer to one another.

Preferably, the fastening formations and associated fastening counter-formations are perfectly aligned when they are lined up with one another in the effective direction of gravity g.

This is the case in FIG. 4.

Figure 5:
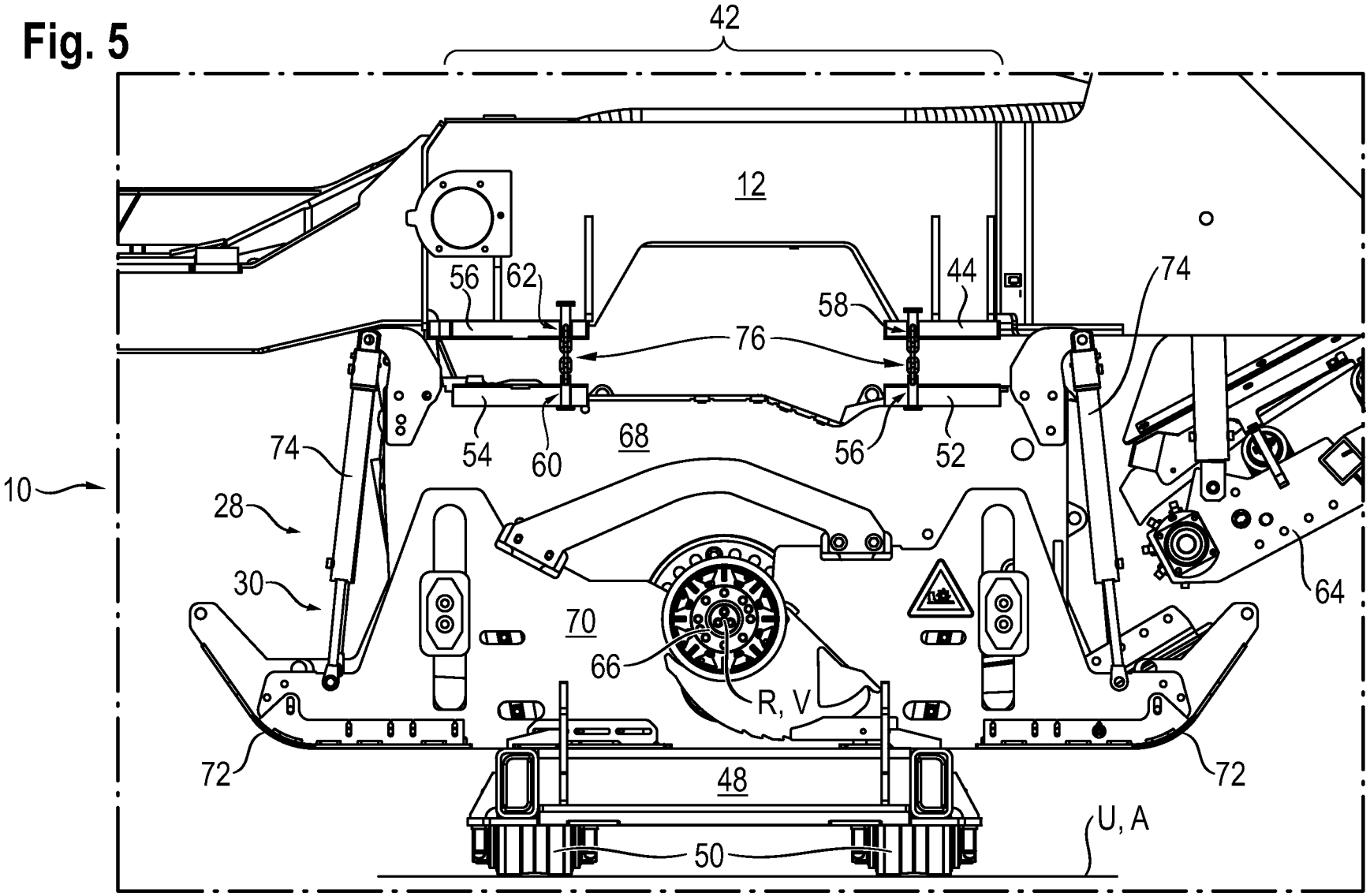
FIG. 5 shows the view of FIG. 4 with the milling device, aligned relative to the machine frame, set back down onto the substrate.

FIG. 5 depicts the state in which milling device 28, after alignment by being allowed to hang freely on machine frame 12, is set back down onto substrate U. Machine frame 12 is brought sufficiently close to milling device 28 that connecting apparatus 76 can be removed again from machine frame 12 and from milling device 28. The state of machine frame 12 and of milling device 28 thus corresponds to that of FIG. 3, except that milling device 28 is now aligned relative to machine frame 12 for operable fastening thereonto.

Figure 6:
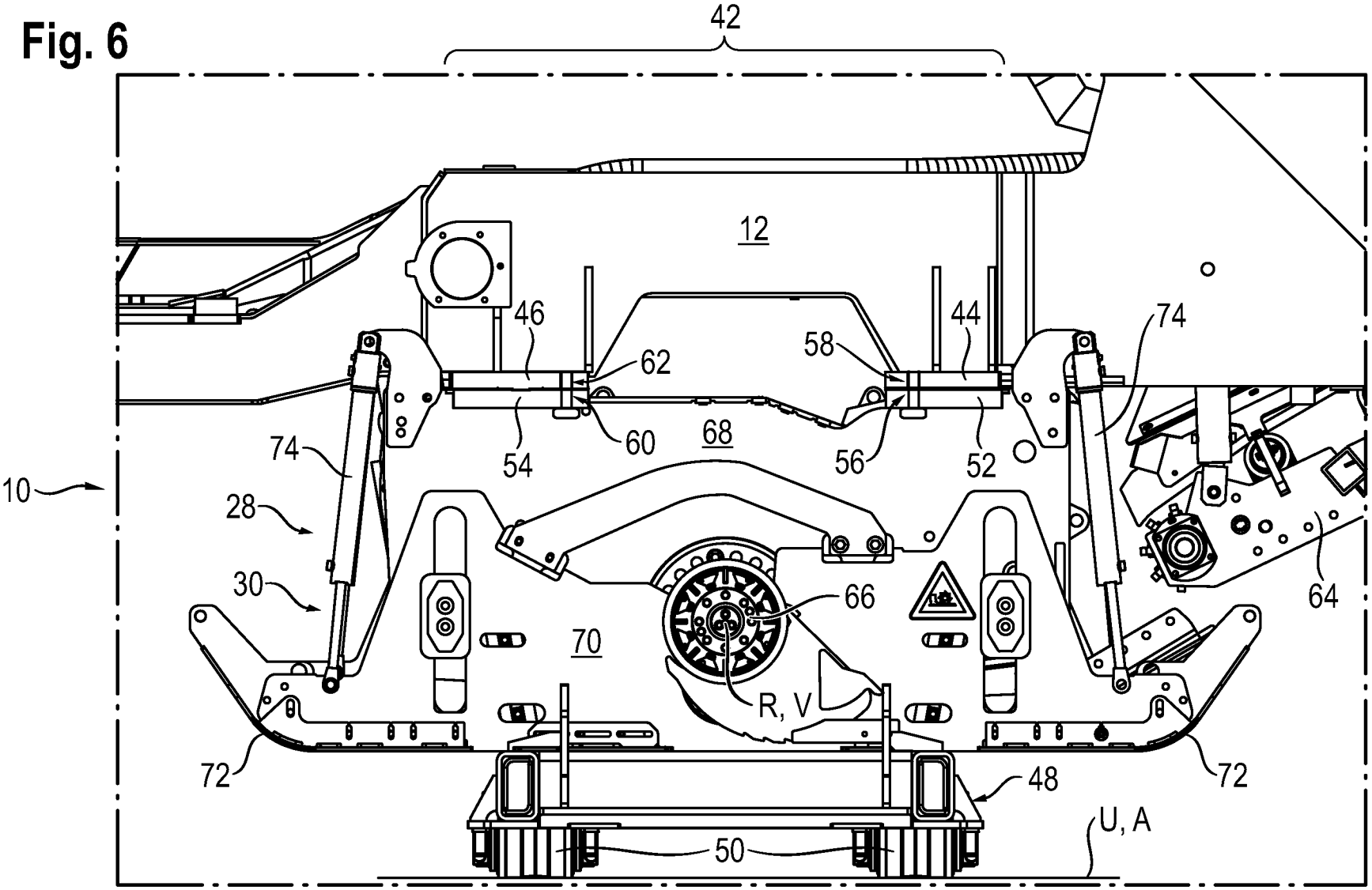
FIG. 6 shows the view of FIG. 5 with fastening counterformations of the machine frame and of the receiving portion moved closer to the fastening formations of the working device.

In FIG. 6, after the removal of connecting apparatus 76 machine frame 12 is now brought all the way against milling device 28 so that installation plates 52 and 44 on the one hand, and 54 and 46 on the other hand, touch one another. Because of the alignment previously carried out, fastening formations 56 and 60 are lined up with fastening counter-formations 58 and 62 respectively associated with them, so that in the state shown in FIG. 6, milling device can be fastened operably, i.e. in operational readiness to carry out an earth-removing milling task, onto machine frame 12. As can be seen in FIG. 6, in the illustrated embodiment the fastening formations 56 and 60 and the fastening counter-formations 58 and 62 may be described as openings or bores.

Figure 7:
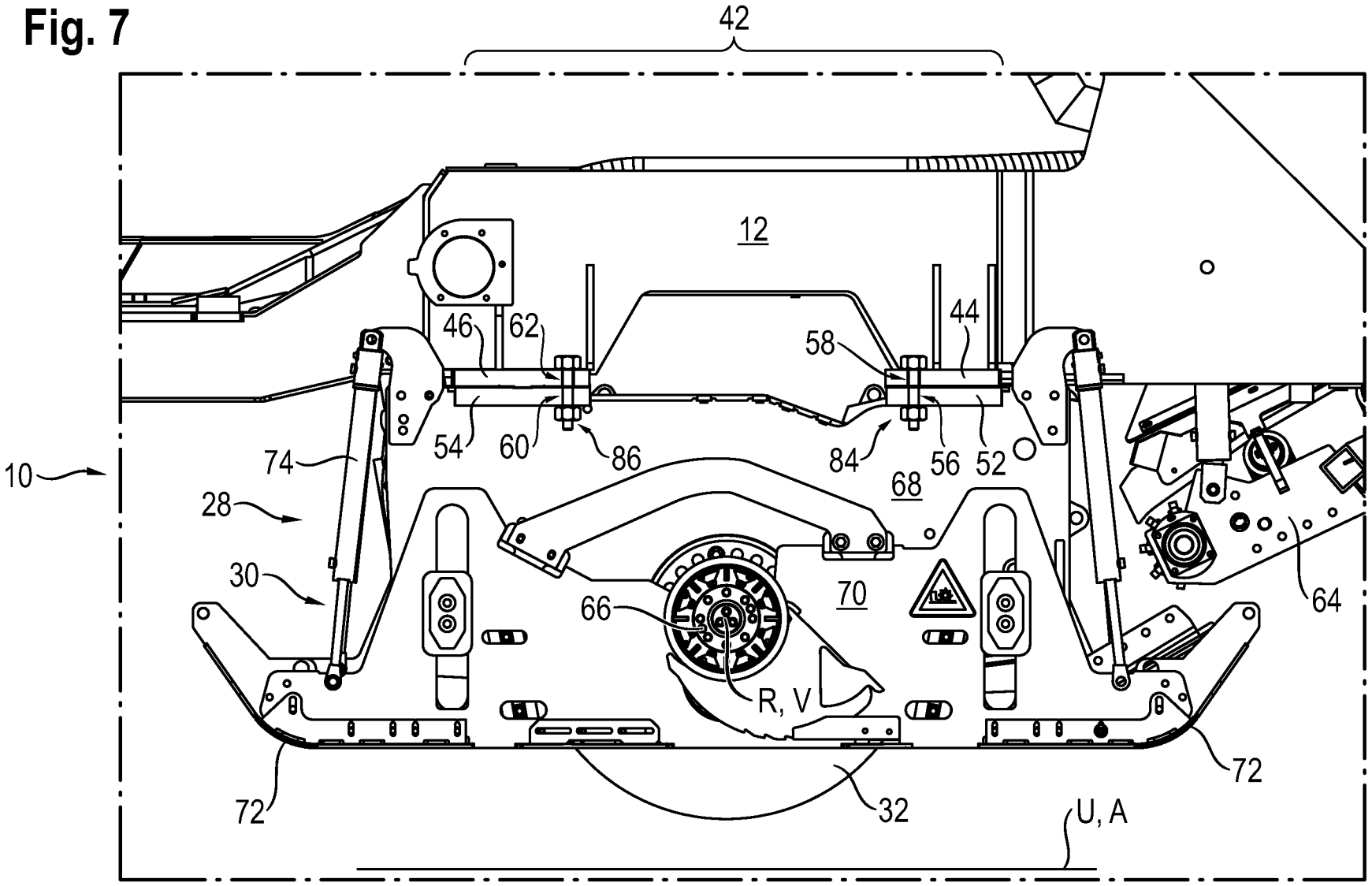
FIG. 7 shows the view of FIG. 6, with the milling device fastened operably onto the machine frame.

FIG. 7 shows earth working machine 10 with milling device 28 fastened operably onto machine frame 12. Fastening means 84 and 86 respectively pass through fastening formation 56 and fastening counter-formation 58, and through fastening formation 60 and fastening counter-formation 62. By way of example, fastening means 84 and 86 are a screw/nut combination. Any other known fastening means can be used, however, instead of fastening means 84 and 86 that are depicted, for example fastening bolts or hydraulically actuatable quick fasteners, which can be provided permanently on machine frame 12 and/or on milling device 28 in order to establish and release a fastening engagement.

With the method presented here, working devices in general can be easily and quickly aligned relative to machine frame 12 of an earth working machine 10, and fastened thereonto, with no appreciable additional devices.

Maneuvering apparatus 48 depicted in the Figures described above does not necessarily have to be used. Machine frame 12 can be moved in a manner known per se parallel to transverse machine direction Q over a working device 28 in contact with substrate U.

The vertical position of working device 28 relative to machine frame 12 can also be established using other lifting devices in addition or alternatively to the on-board lifting columns 14 and 16. For example, maneuvering apparatus 48 could comprise a liftable and lowerable platform on which the working device rests on maneuvering apparatus 48

The invention claimed is:

1. A method of coupling a machine frame of an earth working machine to a working device, the method comprising:

(a) arranging the machine frame and the working device relative to one another such that the working device is located between the machine frame and a substrate with which the earth working machine is in contact;

(b) aligning the machine frame and the working device relative to one another such that in an aligned state of the working device fastening formations of the working device are lined up, along a spacing direction having a directional component orthogonal to the substrate, with fastening counter-formations of the machine frame, the fastening formations and the fastening counter-formations being configured to allow the working device to be fastened to the machine frame using the fastening formations and the fastening counter-formations, the aligning step including:

(b)(1) connecting the machine frame and the working device to one another with a connector including at least one frame coupling portion coupled to the machine frame and at least one device coupling portion arranged at a distance from the frame coupling portion and coupled to the working device, the connector being configured such that in response to a weight of the working device the working device is movable relative to the machine frame parallel to an effective direction of gravity and orthogonally to the effective direction of gravity; then (b)(2) allowing the working device to hang from the machine frame on the connector until the working device rests in the aligned state with the connector extending parallel to the effective direction of gravity; and then (b)(3) supporting the working device;

(c) bringing the fastening formations and the fastening counter-formations closer to one another; and (d) operably fastening the working device to the machine frame;

wherein step (b)(1) includes:

connecting the device coupling portion to at least one device coupling formation of the working device; and connecting the frame coupling portion to at least one frame coupling formation of the machine frame; and wherein the at least one device coupling formation is one of the fastening formations.

2. The method of claim 1, wherein:

the at least one frame coupling formation is one of the fastening counter-formations.

3. The method of claim 1, wherein:

the spacing direction is parallel to the effective direction of gravity.

4. The method of claim 1, wherein:

step (b) includes adjusting a position of the working device and the machine frame relative to one another.

5. The method of claim 1, wherein:

step (b)(3) is executed when the fastening formations and the fastening counter-formations are arranged with a spacing from one another in the effective direction of gravity and are lined up with each other.

6. The method of claim 1, further comprising:

after step (b)(3) and before step (d), removing the connector from the machine frame and the working device.

7. The method of claim 6, further comprising:

replacing the connector with at least one rigid fastener.

8. The method of claim 1, wherein:

in step (b)(1) the connector includes a plurality of sub-connectors, each sub-connector including one of the frame coupling portions and one of the device coupling portions.

9. The method of claim 1, wherein:

in step (b) the fastening formations and the fastening counter-formations comprise openings or bores; and step (d) includes operably fastening the working device to the machine frame via fastening bolts or screws received through the openings or bores.

10. A method of coupling a machine frame of an earth working machine to a working device, the method comprising:

(a) arranging the machine frame and the working device relative to one another such that the working device is located between the machine frame and a substrate with which the earth working machine is in contact;

(b) aligning the machine frame and the working device relative to one another such that in an aligned state of the working device fastening formations of the working device are lined up, along a spacing direction having a directional component orthogonal to the substrate, with fastening counter-formations of the machine frame, the fastening formations and the fastening counter-formations being configured to allow the working device to be fastened to the machine frame using the fastening formations and the fastening counter-formations, the aligning step including:

(b)(1) connecting the machine frame and the working device to one another with a connector including at least one frame coupling portion coupled to the machine frame and at least one device coupling portion arranged at a distance from the frame coupling portion and coupled to the working device, the connector being configured such that in response to a weight of the working device the working device is movable relative to the machine frame parallel to an effective direction of gravity and orthogonally to the effective direction of gravity; then (b)(2) allowing the working device to hang from the machine frame on the connector until the working device rests in the aligned state with the connector extending parallel to the effective direction of gravity; and then (b)(3) supporting the working device;

(c) bringing the fastening formations and the fastening counter-formations closer to one another; and (d) operably fastening the working device to the machine frame;

wherein step (b)(1) includes:

connecting the device coupling portion to at least one device coupling formation of the working device; and connecting the frame coupling portion to at least one frame coupling formation of the machine frame; and the at least one frame coupling formation is one of the fastening counter-formations.

* * * * *